US005130754A

United States Patent [19]

Hishikawa

[11] Patent Number: 5,130,754

[45] Date of Patent: Jul. 14, 1992

[54] CONVEYING ROTATABLE MEMBER AND CONVEYING APPARATUS

[75] Inventor: Yasuhide Hishikawa, Yokohama, Japan

[73] Assignee: Canon Kabushiki Kaisha, Tokyo, Japan

[21] Appl. No.: 502,804

[22] Filed: Mar. 29, 1990

[30] Foreign Application Priority Data

Apr. 3, 1989 [JP] Japan ..... 1-81542

[51] Int. Cl.[5] ..... G03G 15/20; B30B 3/00

[52] U.S. Cl. ..... 355/282; 29/122; 100/155 R; 162/271; 271/272

[58] Field of Search ..... 355/282, 285, 295; 29/122, 129.5; 226/168, 181, 183, 184, 190; 100/93 RP, 162 B, 155 R, 158 R; 162/270, 271; 271/272

[56] References Cited

U.S. PATENT DOCUMENTS

| | | | |
|---|---|---|---|
| 2,648,122 | 8/1953 | Hornbostel | 100/155 R |
| 2,766,559 | 10/1956 | Pixley | 29/122 |
| 3,999,038 | 12/1976 | Sikes, Jr. et al. | 29/122 X |
| 4,008,955 | 2/1977 | Bar-on | 355/284 |
| 4,609,320 | 9/1986 | Rubin | 226/190 X |
| 4,667,863 | 5/1987 | Brunner et al. | 226/190 X |
| 4,682,878 | 7/1987 | Takizawa et al. | 355/282 X |
| 4,693,587 | 9/1987 | Shigenobu et al. | 355/295 |
| 4,856,313 | 8/1989 | Miura et al. | 29/122 X |

FOREIGN PATENT DOCUMENTS

| | | |
|---|---|---|
| 3108095 | 3/1981 | Fed. Rep. of Germany . |
| 61-43775 | 3/1986 | Japan . |
| 63-182166 | 7/1988 | Japan . |

*Primary Examiner*—Joan H. Pendegrass
*Assistant Examiner*—Nestor R. Ramirez
*Attorney, Agent, or Firm*—Fitzpatrick, Cella, Harper & Scinto

[57] ABSTRACT

Disclosed is an image forming apparatus with an image forming device for forming an unfixed image on a recording material and; first and second rotatable members for forming a nip for conveying the recording material supporting the unfixed image. The second rotatable member has its maximum diameters between a longitudinal center and one longitudinal end and between the center and the other longitudinal end thereof.

45 Claims, 5 Drawing Sheets

CONVEYING ROTATABLE MEMBER AND CONVEYING APPARATUS

FIELD OF THE INVENTION AND RELATED ART

The present invention relates to a conveying roller and a conveying apparatus usable in an image fixing apparatus wherein a recording material is conveyed and fixed, more particularly to a conveying apparatus usable with an image forming apparatus such as an electrophotographic copying machine, a light printer or an electrostatic printer.

A roller type image fixing apparatus shown in FIG. 5 is widely used for fixing an image in an image forming apparatus such as an electrophotographic apparatus. In this type of the apparatus, the recording material carrying an unfixed toner image received by the fixing apparatus 100 is passed through a nip formed between an image fixing roller 110 and a pressing or back-up roller 120 press-contacted thereto, and during the passage, the toner image is fixed into a permanent image on the recording material by pressure or by pressure and heat.

In such a roller type fixing apparatus, the recording material is sometimes wrinkled. The wrinkle occurs frequently when the size of the recording material is large. In order to prevent the occurrence of the wrinkle, one of the fixing roller 110 and the pressing roller 120, for example, the pressing roller 120 is given a so-called reverse-crowning, that is, the longitudinal central portion of the pressing roller 120 is given a minimum diameter, and the longitudinal opposite ends are given the maximum diameter, by which forces are applied to the recording material in the direction toward the outside of the recording material in the longitudinal axis direction of the roller.

FIG. 6 shows an example of the pressing roller which is reversely crowned. When the pressing roller 120 reversely crowned is press-contacted to the fixing roller 110 having a usual circular cylindrical form, the conveying speed is higher at the longitudinal end portions than at the central portion of the recording material P. Therefore, the recording material P receives tension forces toward longitudinally outside of the pressing roller 120. As shown in FIG. 7, the recording material P receives force F indicated by the arrows as a result of combination with the conveying force. Accordingly, the recording material P is stretched in a direction perpendicular to the conveying direction, so that the wrinkle in the recording material P is prevented. The amount of the reverse-crowning, that is, the difference between the maximum diameter and the minimum diameter is usually several hundreds microns. If the amount of the reverse-crowning is increased, the wrinkle preventing effect is increased. However, the recording material or sheet P is forcedly stretched in the longitudinal direction of the pressing roller 120, and therefore, if the recording material P is a thin sheet of paper, the recording material P is waved after it passes through the nip between the fixing roller 110 and the pressing roller 120, as shown in FIG. 8. If the waved recording material is subjected to an additional image forming operation for the purpose of forming an image on the backside of the recording material or forming a superposed image on the same side of the recording material, the transfer of the additional image is sometimes not proper. The end portions 120*a* and 120*b* of the pressing roller 120 reversely crowned constitute acute angles $\phi$ and $\phi'$, and larger force is applied to the fixing roller 110 at the end portions than at the central portion. For those reasons, the amount of wearing of the fixing roller 110 is larger at its end portions due to such natures of the end portions 120*a* and 120*b* of the pressing roller 120.

SUMMARY OF THE INVENTION

Accordingly, it is a principal object of the present invention to provide a conveying rotatable member and a conveying apparatus having a high wrinkle preventing effect and a high waving preventing effect.

It is another object of the present invention to provide a conveying apparatus having a rotatable member which has the maximum diameter at a position between the longitudinal center and the longitudinal end thereof.

It is a further object of the present invention to provide a conveying apparatus wherein the recording material receives both of outward force and inward force while the recording material is being conveyed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 1:
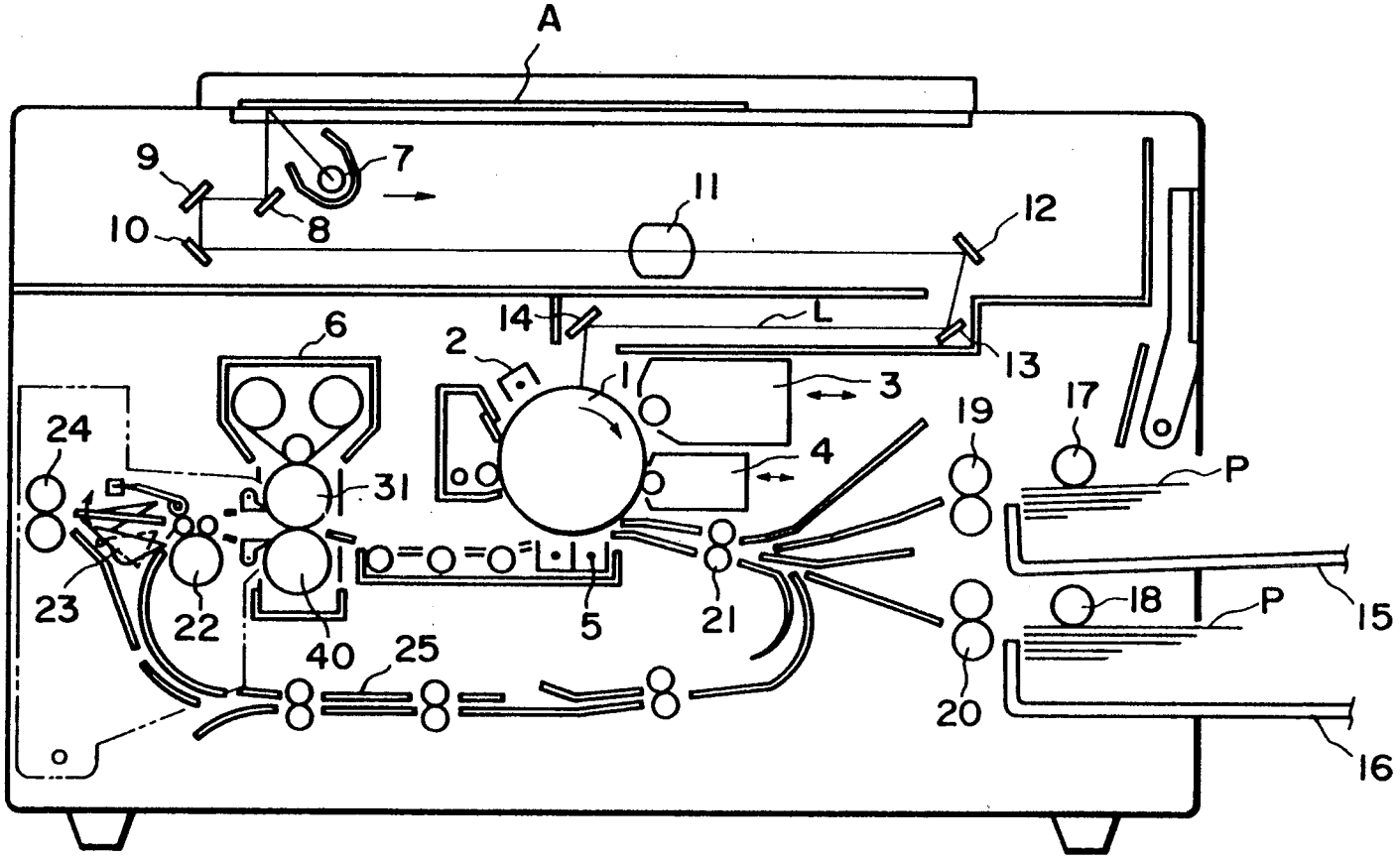
FIG. 1 is a sectional view of a copying apparatus including an image fixing device according to an embodiment of the present invention.

Referring to FIG. 1, there is shown an image forming apparatus using the image fixing apparatus according to an embodiment of the present invention. The exemplary image forming apparatus is capable of forming duplex copy (having images on both sides) and capable of forming a superposed image (multiplex images are superposedly formed on one side of the recording material).

The image forming apparatus has a photosensitive drum (image bearing member) 1. The drum 1 is uniformly charged electrically by a primary charger 2, and is exposed to image light L, so that an electrostatic latent image is formed on the photosensitive drum 1. The electrostatic latent image is visualized into an unfixed toner image by a color developing device 3 containing chromatic (red, blue or the like) toner or by a black developing device 4 containing black toner, the developing devices being movable in the direction indicated by arrows. In the state shown in this figure, the black developing device 4 is placed close to the photosensitive drum 1, and therefore, a black toner image is formed on the photosensitive drum 1. The image light L is provided by an original A scanned by the lamp 7 and mirrors 8, 9 and 10 and is projected onto the photosensitive drum 1 through a zoom lens 11 and mirrors 12, 13 and 14.

An image transfer sheet (recording material) P on which the toner image is transferred is fed to a registration roller 21 from a cassette 15 or 16 by a pick-up roller 17 or 18 and by conveying rollers 19 or 20. The transfer sheet P is advanced to the photosensitive drum 1 in a timed relation with the image on the photosensitive drum 1 by the registration rollers 21. The toner image is transferred from the photosensitive drum 1 onto the transfer sheet P by the transfer charger 5. The transfer sheet P is conveyed to an image fixing device 6 in which it is conveyed through the nip formed between the rollers 31 and 40, by which the toner image is fixed on the transfer sheet P.

The transfer sheet P having been subjected to the image fixing operation is discharged outside the apparatus by first conveying rollers 22, through a flapper 23 and by second conveying rollers 24. When an additional image is to be formed on the backside of the transfer sheet P, that is, when the duplex image is to be formed, the transfer sheet retained by the nip of the second conveying rollers 24 is moved back to a reconveying passage 25 by reverse rotation of the second conveying rollers 24, by which the transfer sheet is fed again to the photosensitive drum 1 with the fixed image bearing side face down. Onto the backside of the transfer sheet, an additional unfixed toner image is transferred, and then, it is discharged outside the apparatus by the second conveying rollers 24.

When a superposed image is to be copied on the same side of the transfer sheet P, the flapper 23 takes the position shown by broken lines to introduce the transfer sheet P into the re-conveying passage 25, by which the transfer sheet P is conveyed again to the transfer station with its fixed image bearing side face up. Thus, an additional unfixed toner image is transferred onto the same side, and thereafter, the unfixed toner image is fixed, and it is discharged outside the apparatus by the second conveying roller 24. The transfer sheet P being conveyed in the reconveying passage 25 is fed to the photosensitive drum 1 at proper timing by the registration rollers 21, and the transfer charger 5 transfers the additional toner image from the photosensitive drum 1 onto the transfer sheet P.

Figure 2:
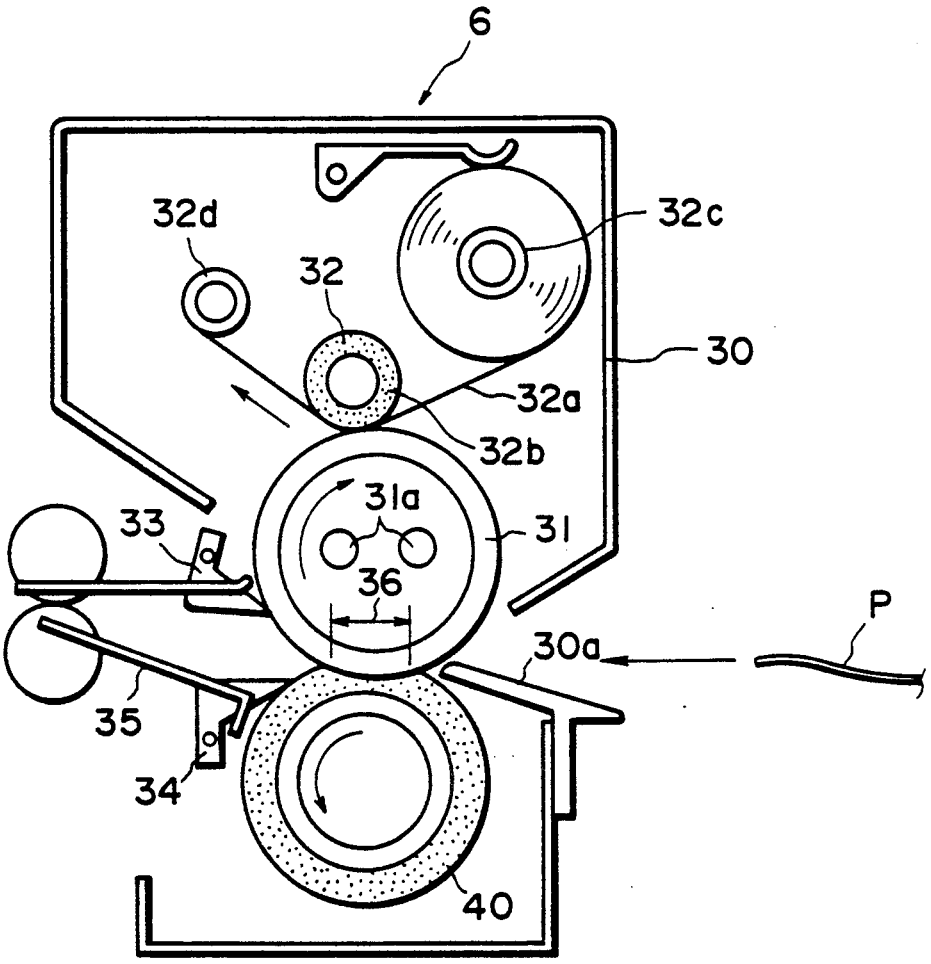
FIG. 2 is a cross-sectional view of the image fixing device used in FIG. 1 apparatus.
Figure 3:
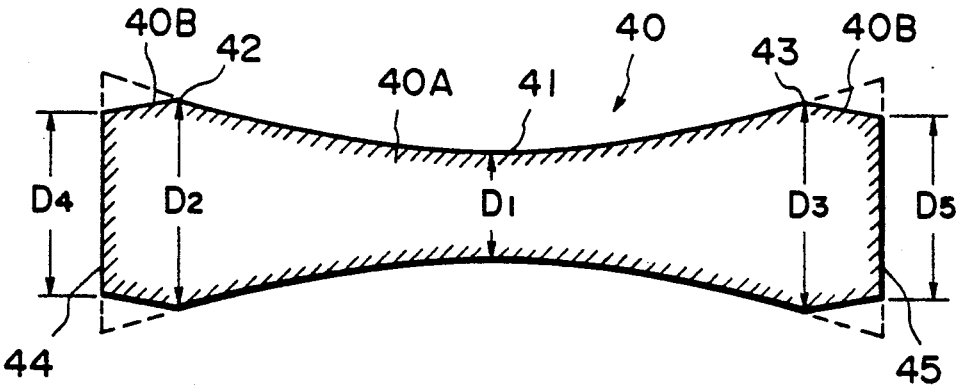
FIG. 3 is a longitudinal sectional view of a pressing roller of the image fixing device shown in FIG. 2.
Figure 4:
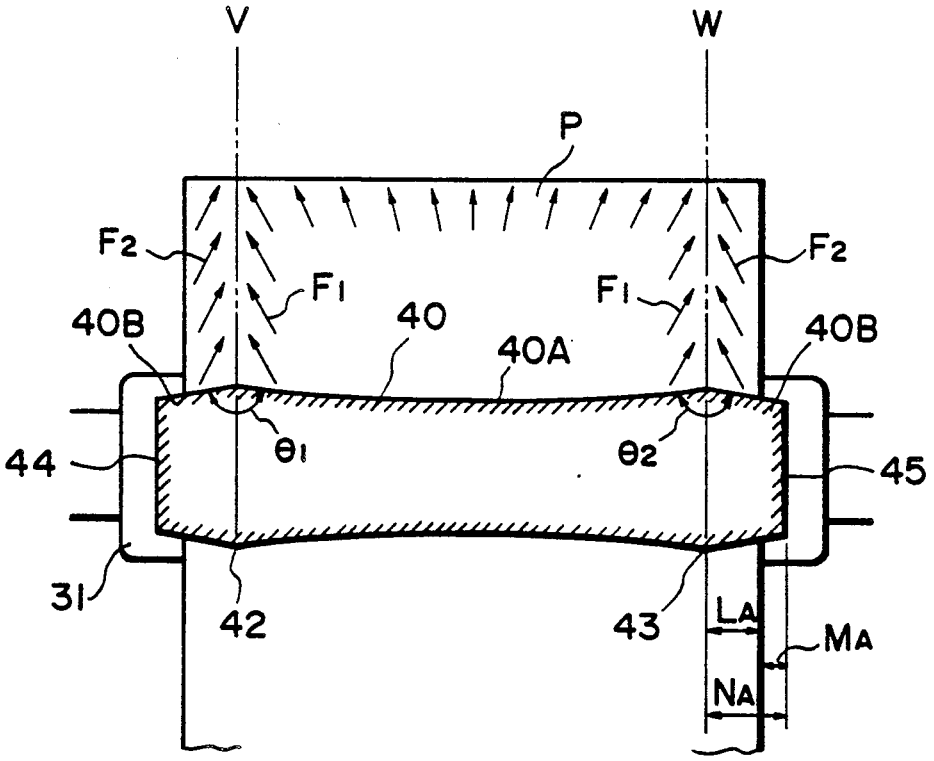
FIG. 4 is a top plan view of the fixing device, illustrating the action of the pressing roller on the recording paper.
Figure 5:
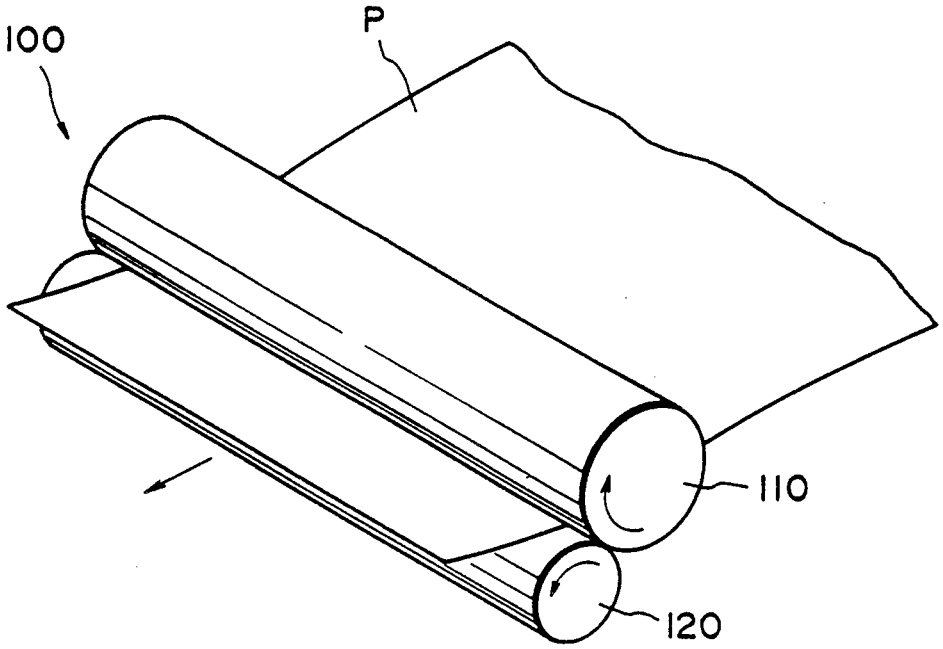
FIG. 5 PRIOR ART
FIG. 5 is a perspective view of a roller fixing apparatus.

Referring to FIGS. 2, 3 and 4, the image fixing device 6 according to this embodiment will be described.

As shown in FIG. 2, the fixing device 6 comprises a straight cylindrical fixing roller 31 and a pressing roller 40 which are press-contacted to each other, a web cleaner 32 for removing the toner offset to the fixing roller 31 and also for applying a parting agent to the fixing roller 31 separating pawls 33 and 34 for separating the transfer sheet P wrapped around the fixing roller 31 or the pressing roller 40, a frame 30 having an inlet guide 30*a* for receiving the transfer sheet P, and a discharging guide 35 for guiding the transfer sheet P. The fixing roller 31 contactable to the toner image on the transfer sheet P is of metal coated with high polymer resin exhibiting high parting property and includes therein an electric heater 31*a* to maintain a constant surface temperature. It is rotationally driven in the direction indicated by an arrow by an unshown driving source.

The pressing roller 40 is made of heat-resistive rubber such as silicone rubber and is press-contacted to the fixing roller 31 by a spring or the like. It rotates following the fixing roller 31. The fixing roller 31 and the pressing roller 40 constitute a nip 36 having an area (surface contact). The nip 36 functions to fix the toner image on the transfer sheet P.

The web cleaner 32 includes a web 32*a* made of nonwoven fabric impregnated with oil (parting agent), an urging roller 32*b* for urging the web 32*a* to the fixing roller 31 to rub it, and core metals 32*c* and 32*d* for feeding the web 32*a* by predetermined intermittent amount of rotational movement. During the fixing operation, the web 32*a* removes the toner offset to the fixing roller 31, and applies the oil in the web 32*a* to the fixing roller 31 to prevent the toner from being deposited on the fixing roller 31.

In operation, when the transfer sheet P carrying the toner image is introduced into the fixing device 6, the transfer sheet P is passed through the nip 36 formed between the fixing roller 31 and the pressing roller 40, by which the toner image is heated and pressed so as to be fused and fixed on the transfer sheet P. The transfer sheet on which the toner image has been fixed is separated from the fixing roller 31 or the pressing roller 40 by the separating pawl 33 or 34, and is conveyed to the first conveying roller 22 along the guide 35. The portion of the fixing roller at which the fixing operation is completed, is cleaned by the web cleaner 32 so that the offset toner is removed therefrom.

The description will be made as to the pressing roller 40 used in this embodiment. As shown in FIG. 3, the pressing roller 40 has a generally reversely crowned configuration having a minimum diameter portion 41 in the longitudinal center thereof in order to prevent wrinkle of the transfer sheet P in the nip 36 during the fixing operation.

Figure 6:
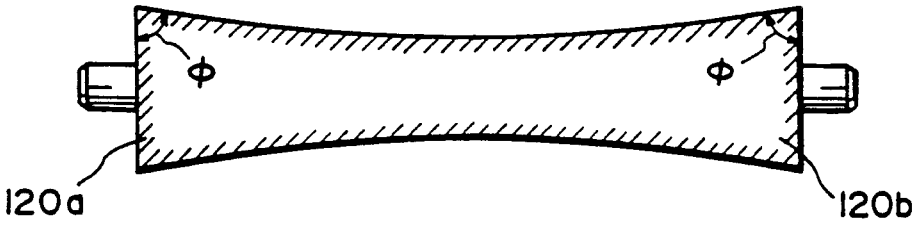
FIG. 6 PRIOR ART
FIG. 6 shows a configuration of a conventional roller.
Figure 7:
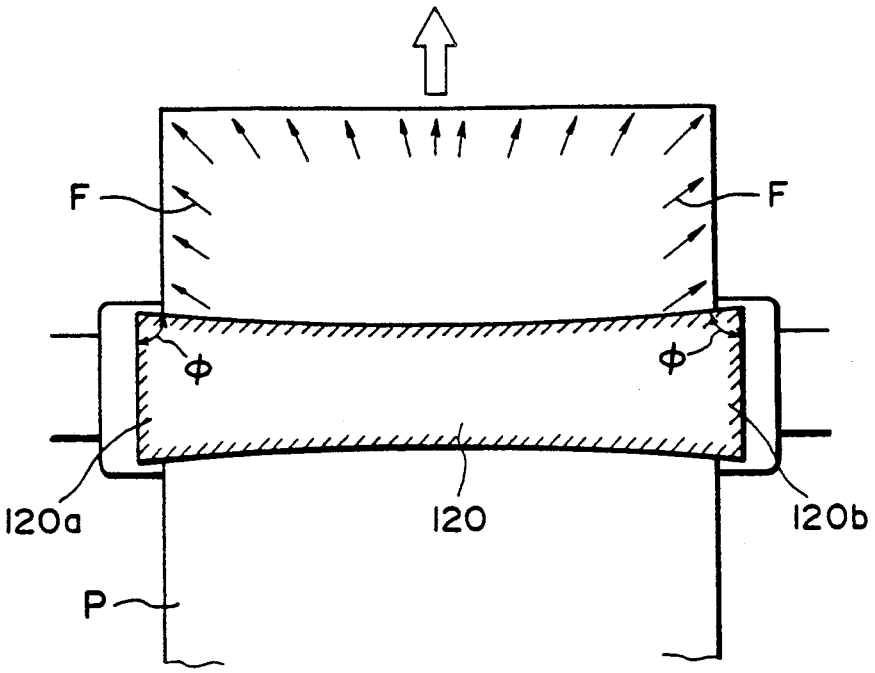
FIG. 7 PRIOR ART
FIG. 7 illustrates the action of the roller of FIG. 6 on the recording paper.
Figure 8:
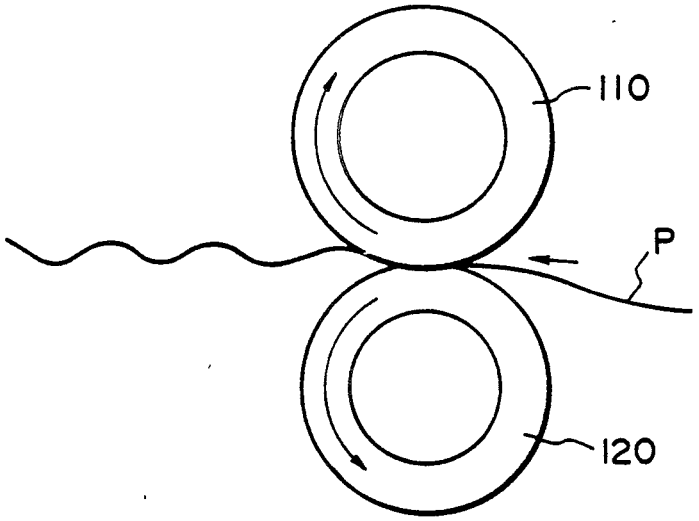
FIG. 8 PRIOR ART
FIG. 8 is a cross-sectional view of the rollers, illustrating the problem with the roller of FIG. 6.

In the examples shown in FIGS. 6 and 7, the longitudinal opposite ends of the pressing roller 120 have the maximum diameter to apply to the transfer sheet P outward forces in the direction of the generating line of the roller.

On the contrary, in this embodiment, the outer circumferential periphery at the opposite longitudinal end portions of the pressing roller where it is contacted to the transfer sheet P less frequently, is removed by a predetermined amount, so that the maximum diameter portions 42 and 43 appear at positions inside from the longitudinal end surfaces 44 and 45 of the pressing roller 40 by predetermined distances. The maximum diameter portions 42 and 43 are within the maximum width of usable recording materials. Thus, the pressing roller 40 has a reverse-crowned portion 40A and cut portions 40B and 40B continuing from the opposite longitudinal ends of the reverse-crowned portion 40A, and the following is satisfied:

$$D2 > D1,\ D2 \geqq D4,\ D3 > D1,\ \text{and}\ D3 \geqq D5$$

where D1 is the minimum diameter, D2 and D3 are maximum diameters, and D4 and D5 are diameters at the longitudinal ends.

Since the pressing roller 40 has the reverse-crowned portion 40A and the cut portions 40B and 40B, the transfer sheet P received from the reverse-crowned portion 40A outward tension force in the direction of the longitudinal axis of the pressing roller 40, and the tension forces are combined with the conveying force to the transfer sheet P, by which as shown in FIG. 4 the transfer sheet P receives the resultant forces F1, F2 toward the maximum diameter portions 42 and 43 of the pressing roller 40, more particularly toward a line V and a line W in the oblique outward directions. In the cut portions 40B and 40B, the transfer sheet P receives inward tension forces with respect to the direction of the axis of the pressing roller 40. The forces are combined by the conveying force to the transfer sheet P, so that the transfer sheet P receives the resultant forces F2, F1 toward the line V and the line W in the oblique inward direction. Therefore, a line (straight slight recess) is formed along the lines V and W by the forces F1, F1, F2 and F2. By this, the rigidity of the transfer sheet P is increased in the conveyance direction, so that the transfer sheet P is prevented from waving after the image fixing action. Thus, even when additional image is transferred thereafter onto the same side of the transfer sheet P, or even when an additional toner image is transferred onto the backside of the transfer sheet P, the images can be properly transferred. The cut portions 40B and 40B of the pressing roller 40 apply the forces F2 and F2 to the transfer sheet P. This increases the tendency of wrinkle occurrence in the transfer sheet P. Generally, however, the lateral end portions of the transfer sheet P is not easily wrinkled, and therefore, the forces F2 and F'2 are only effective to form lines along the lines V and W to which the forces are concentrated by combination with the forces F1 and F1 provided by the reverse-crowned portion 40A, and therefore, no practical wrinkle occurs.

The longitudinal lengths of the cut portions 40B and 40B is sufficiently small as compared with that of the reverse-crowned portion 40A so that no wrinkle is produced by the force F2 at the cut portion 40B.

Since the maximum diameters D2 and D3 of the pressing roller 40 are smaller than the diameter at the longitudinal ends, the pressing roller 40 and the fixing roller 31 are contacted relatively uniformly along the length thereof, and therefore, the pressure at the maximum diameter portions 42 and 43 of the pressing roller 40 is small, and in addition, the angles $\theta 1$ and $\theta 2$ at the maximum diameter portions 42 and 43 of the pressing roller 40 (FIG. 4) are not acute but obtuse, so that the pressure applied to the fixing roller 31 by the maximum diameter portions 42 and 43 of the pressing roller 40 is eased, and therefore, the possibility of the damage of the fixing roller 31 by the pressing roller 40 decreases.

In this embodiment, the transfer sheet receives the force at the cut portion 40B in the direction opposite to the direction of the force applied by the reverse-crowned portion 40A, so that the transfer sheet is prevented from waving. If the amount or degree of the crowning is large, it is preferable that the angles $\theta 1$ and $\theta 2$ (FIG. 4) are reduced. In order to suppress the reduction of the angles $\theta 1$ and $\theta 2$, the difference between the maximum diameter and the minimum diameter is not more than 200 microns.

In this embodiment, $D4 > D1$, and $D5 > D1$, so that the inward force by the cut portion 40B is smaller than the outward force by the reverse-crowned portion 40A.

The positional relationship between the transfer sheet P and the pressing roller 40 is as shown in FIG. 4, and the distance $L_A$ between the maximum diameter portion (43, for example) and the end of the transfer sheet P is preferably 5–40 mm. If it is larger than 40 mm, the wrinkle preventing effect by the reverse-crowned portion 40A decreases. If it is smaller than 5 mm, the line formed in the transfer sheet P after it passes through the nip between the fixing roller 31 and the pressing roller 40 becomes closer to the lateral end of the transfer sheet P, with the result that the wave preventing effect for the transfer sheet P decreases. From the standpoint of reducing the size of the apparatus and reducing the energy consumption (reduction of the heat absorption away from the fixing roller 31) or the like, the length of the pressing roller 40 is minimized. Therefore, a distance $M_A$ between an end of the transfer sheet P and the end face 45 of the pressing roller 40 is usually approximately 5 mm. Therefore, the length $N_A$ of the cut portion 40B of the pressing roller preferably satisfies $N_A = L_A + M_A = 10$–$45$ mm.

In this embodiment, the reverse-crowned rotatable member is the pressing roller, but it may be the fixing roller, that is, the roller contactable to the unfixed toner image or may be a transfer roller press-contacted to the photosensitive drum.

It is preferable that the reversely crowned portion has sufficient elasticity, and therefore, it is preferable that it includes a rubber layer.

The rotatable member is no limited to the roller, but it may be in the form of a belt.

While the invention has been described with reference to the structures disclosed herein, it is not confined to the details set forth and this application is intended to cover such modifications or changes as may come within the purposes of the improvements or the scope of the following claims.

What is claimed is:

1. A conveying rotatable member for forming a nip to convey a recording material, comprising:

a first maximum diameter portion located between a longitudinal center and one longitudinal end thereof; and a second maximum diameter portion located between the longitudinal center and the other longitudinal end thereof;

wherein a diameter of said rotatable member longitudinally outside of said first and second maximum diameter portions continuously reduces toward the respective longitudinal ends.

2. A member according to claim 1, wherein the first and second maximum diameter portions are within a recording material conveying region.

3. A member according to claim 1, wherein said rotatable member is reversely crowned except for longitudinal end portions.

4. A member according to claim 3, wherein said rotatable member has a minimum diameter at its longitudinally central portion, and a difference between a maximum diameter of said rotatable member and the minimum diameter is not more than 200 microns.

5. A member according to claim 1, wherein a distance between each of said first and said second maximum diameter portions and the end adjacent thereto is 10–45 mm.

6. A member according to claim 1, wherein said rotatable member is an elastic rotatable member having a rubber layer.

7. A member according to claim 1, wherein said rotatable member is used to fix an unfixed image on the recording material.

8. A member according to claim 7, wherein said rotatable member is a pressing rotatable member contactable to a side of the recording material which is opposite from a side thereof carrying the unfixed toner image.

9. A recording material conveying apparatus, comprising:

a first rotatable member;

a second rotatable member press-contacted to said first rotatable member to form a nip therebetween for conveying the recording material;

wherein said second rotatable member has a first maximum diameter portion located between a longitudinal center and one longitudinal end of a recording material passing range and a second maximum diameter portion located between the longitudinal center and the other longitudinal end of the recording material passing range, wherein a diameter of said second rotatable member longitudinally outside said first and second maximum diameter portions continuously reduces toward the respective longitudinal ends of the recording material passing range.

10. An apparatus according to claim 9, wherein said second rotatable member is reversely crowned except for longitudinal end portions.

11. An apparatus according to claim 10, wherein said second rotatable member has a minimum diameter at its longitudinally central portion, and a difference between a maximum diameter of said rotatable member and the minimum diameter is not more than 200 microns.

12. An apparatus according to claim 11, wherein a distance between the maximum diameter portion and the end adjacent thereto is 10–45 mm.

13. An apparatus according to claim 11, wherein said second rotatable member is an elastic rotatable member having a rubber layer.

14. An apparatus according to claim 11, wherein said first and second rotatable members convey the recording material carrying an unfixed toner image to fix the toner image.

15. An apparatus according to claim 11, wherein said second rotatable member is a pressing rotatable member contactable to a side of the recording material which is opposite from a side thereof carrying the unfixed toner image.

16. An apparatus according to claim 11, wherein said first rotatable member is of a uniform diameter.

17. A recording material conveying apparatus, comprising:

a first rotatable member;

a second rotatable member cooperative with said first rotatable member to form a nip therebetween to convey a recording material;

wherein said rotatable members apply to the recording material both outward force and inward force in a direction of a generating line of said rotatable members, said inward force smaller than said outward force.

18. An apparatus according to claim 17, wherein the inward force is applied to the recording material in regions outside of a region where the outward force is applied, in the direction of the generating line.

19. An apparatus according to claim 18, wherein the inward force is applied to lateral end portions of the recording material.

20. An apparatus according to claim 18, wherein the inward force applying regions are smaller than the outward force applying region.

21. An apparatus according to claim 14 or 22, wherein further comprising an image bearing member for bearing the unfixed image, transfer means for transferring the unfixed image from said image bearing member to the recording material and conveying means for conveying the recording material on which the unfixed toner image is fixed by said rotatable members to said image transfer means with its fixed image side thereof facing said image bearing member.

22. An apparatus according to claim 17, wherein said rotatable members convey the recording material which carries an unfixed image to fix the image.

23. An apparatus according to claim 14 or 22, wherein further comprising an image bearing member for bearing the unfixed image, transfer means for transferring the unfixed image from said image bearing member to the recording material and conveying means for conveying the recording material on which the unfixed toner image is fixed by said rotatable members to said image transfer means with its fixed image side facing away from said image bearing member.

24. A recording material conveying apparatus, comprising:

a first rotatable member; and a second rotatable member press-contacted to said first rotatable member to form a nip therebetween for conveying the recording material, wherein said second rotatable member has a first maximum diameter portion located between a longitudinal center and one longitudinal end of a recording material passing range and a second maximum diameter portion located between the longitudinal center and the other longitudinal end of the recording material passing range, the first and second maximum diameter portions have the same diameter, and a difference between the diameter of the maximum diameter portions and the diameter of the longitudinal center is larger than a difference between the diameter of the maximum diameter portions and the diameter of the longitudinal ends of the recording material passing range.

25. An apparatus according to claim 24, wherein said second rotatable member is reversely crowned except for the area between the longitudinal end portions and the nearest maximum diameter portions.

26. An apparatus according to claim 24, wherein said second rotatable member has a minimum diameter at its longitudinally central portion, and a difference between a maximum diameter and the minimum diameter is not more than 200 microns.

27. An apparatus according to claim 24, wherein a distance between each maximum diameter portion and the end adjacent thereto is 10–45 mm.

28. An apparatus according to claim 24, wherein said second rotatable member is an elastic rotatable member having a rubber layer.

29. An apparatus according to claim 24, wherein said first and second rotatable members convey the recording material carrying an unfixed toner image to fix the toner image.

30. An apparatus according to claim 29, wherein said second rotatable member is a pressing rotatable member contactable to a side of the recording material which is opposite from a side thereof carrying the unfixed toner image.

31. An apparatus according to claim 29, further comprising an image bearing member for bearing the unfixed image, transfer means for transferring the unfixed image from said image bearing member to the recording material and conveying means for conveying the recording material on which the unfixed toner image is fixed by said rotatable members to said image transfer means with its fixed image side thereof facing said image bearing member.

32. An apparatus according to claim 29, further comprising an image bearing member for bearing the unfixed image, transfer means for transferring the unfixed image from said image bearing member to the recording material and conveying means for conveying the recording material on which the unfixed toner image is fixed by said rotatable members to said image transfer means with its fixed image side thereof facing away from said image bearing member.

33. An apparatus according to claim 24, wherein said first rotatable member has a uniform diameter.

34. An apparatus according to claim 24, wherein the recording material passing range is determined on the basis of the maximum size of the usable recording materials.

35. An image fixing apparatus, comprising:

first and second rotatable members for forming a nip to feed a recording material supporting an unfixed image, said second rotatable member having a diameter which changes continuously along its longitudinal length;

wherein said second rotatable member has a first maximum diameter portion located between a longitudinal center and one longitudinal end of an image fixing region and a second maximum diameter portion located between the longitudinal center and the other longitudinal end of the image fixing region.

36. An apparatus according to claim 35, wherein said second rotatable member is reversely crowned except for the area between each of the longitudinal end portions and its nearest maximum diameter portions.

37. An apparatus according to claim 36, wherein said first rotatable member has a uniform diameter.

38. An apparatus according to claim 36, wherein said apparatus is used with an image forming apparatus for forming an image on a recording material.

39. An apparatus according to claim 38, wherein further comprising an image bearing member for bearing the unfixed image, transfer means for transferring the unfixed image from said image bearing member to the recording material and conveying means for conveying the recording material on which the unfixed toner image is fixed by said rotatable members to said image transfer means with its fixed image side thereof facing said image bearing member.

40. An apparatus according to claim 38, wherein further comprising an image bearing member for bearing the unfixed image, transfer means for transferring the unfixed image from said image bearing member to the recording material and conveying means for conveying the recording material on which the unfixed toner image is fixed by said rotatable members to said image transfer means with its fixed image side thereof facing away from said image bearing member.

41. An apparatus according to claim 35, wherein said second rotatable member has a minimum diameter at its longitudinally central portion, and a difference between either of said maximum diameters and the minimum diameter is not more than 200 microns.

42. An apparatus according to claim 35, wherein a distance between each maximum diameter portion and the end adjacent thereto is 10–45 mm.

43. An apparatus according to claim 35, wherein said second rotatable member is an elastic rotatable member having a rubber layer.

44. An apparatus according to claim 35, wherein said first and second rotatable members convey the recording material carrying an unfixed toner image to fix the toner image.

45. An apparatus according to claim 44, wherein said second rotatable member is a pressing rotatable member contactable to a side of the recording material which is opposite from a side thereof carrying the unfixed toner image.

* * * * *

UNITED STATES PATENT AND TRADEMARK OFFICE

CERTIFICATE OF CORRECTION

PATENT NO. : 5,130,754

DATED : July 14, 1992

INVENTOR(S) : Yasuhide HISHIKAWA

It is certified that error appears in the above-identified patent and that said Letters Patent is hereby corrected as shown below:

COLUMN 5

Line 31, "F'2" should read --F2--.

COLUMN 7

Line 31, "claim 11," should read --claim 9,--.
Line 34, "claim 11," should read --claim 9,--.
Line 37, "claim 11," should read --claim 9,--.
Line 41, "claim 11," should read --claim 9,--.
Line 46, "claim 11," should read --claim 9,--.

COLUMN 8

Line 1, "22," should read --20,--.

Signed and Sealed this

Thirty-first Day of August, 1993

Bruce Lehman

*Attest:*

BRUCE LEHMAN

*Attesting Officer*

*Commissioner of Patents and Trademarks*